US010605558B1

(12) United States Patent
Marfione et al.

(10) Patent No.: US 10,605,558 B1
(45) Date of Patent: Mar. 31, 2020

(54) SUPPRESSOR FOR A FIREARM

(71) Applicants: Anthony Louis Marfione, Fletcher, NC (US); Donald Ray Helms, Pisgah Forest, NC (US)

(72) Inventors: Anthony Louis Marfione, Fletcher, NC (US); Donald Ray Helms, Pisgah Forest, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/275,264

(22) Filed: Feb. 13, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36
See application file for complete search history.

(56) References Cited

U.S. PATENT DOCUMENTS

| | | | | |
|---|---|---|---|---|
| 3,272,074 | A | 9/1966 | Vinson | |
| 4,576,083 | A | 3/1986 | Seberger, Jr. | |
| 4,588,043 | A | 5/1986 | Finn | |
| 4,813,333 | A * | 3/1989 | Garris | F41A 21/38 89/14.3 |
| 4,920,854 | A | 5/1990 | Scanlon | |
| 5,029,512 | A | 7/1991 | Latka | |
| 5,559,302 | A | 9/1996 | Latka | |
| 5,860,242 | A * | 1/1999 | O'Neil | F41C 27/22 42/75.01 |
| 6,575,074 | B1 | 6/2003 | Gaddini | |
| 7,059,235 | B2 * | 6/2006 | Hanslick | F41A 21/38 89/14.3 |
| 7,832,323 | B1 | 11/2010 | Davies | |
| 7,891,282 | B1 * | 2/2011 | DeGroat | F41A 21/325 181/223 |
| 7,931,118 | B1 | 4/2011 | Cronhelm | |
| 8,387,299 | B1 | 3/2013 | Brittingham et al. | |
| 8,584,794 | B2 * | 11/2013 | Dueck | F41A 21/30 181/223 |
| 9,470,466 | B2 | 10/2016 | Washburn, III et al. | |
| 9,599,421 | B1 * | 3/2017 | Dean | F41A 21/30 |

(Continued)

FOREIGN PATENT DOCUMENTS

| | | |
|---|---|---|
| DE | 1553874 | 10/1971 |
| DE | 20 2014 004 278 U1 | 9/2014 |
| EP | 2 587 209 A2 | 5/2013 |

*Primary Examiner* — Derrick R Morgan
(74) *Attorney, Agent, or Firm* — Steve LeBlanc, LLC

(57) ABSTRACT

A suppressor for a firearm includes a casing that defines a rear end opposed to a front end. A plurality of baffles are inside the casing. A rear cap is upstream from the plurality of baffles and releasably coupled to the rear end of the casing, and the rear cap includes an upstream surface. A rear cap surface feature is defined by the upstream surface of the rear cap. A front cap is downstream from the plurality of baffles and releasably coupled to the front end of the casing, and the front cap includes an upstream surface. A front cap surface feature is defined by the front cap, and the front cap surface feature has a complementary shape to the rear cap surface feature so the front cap surface feature can engage with the rear cap surface feature to remove the rear cap from the casing.

17 Claims, 8 Drawing Sheets

(56) References Cited

U.S. PATENT DOCUMENTS

| | | | | |
|---|---|---|---|---|
| 9,658,019 | B2 * | 5/2017 | Smith | F41A 21/30 |
| 9,746,267 | B2 | 8/2017 | Smith | |
| 9,816,773 | B1 * | 11/2017 | Reis Green | F41A 21/30 |
| 10,119,779 | B1 * | 11/2018 | Miele | F41A 21/30 |
| 10,184,745 | B1 * | 1/2019 | Fulton | F41A 21/30 |
| 10,345,070 | B1 * | 7/2019 | Lepka | F41A 21/30 |
| 2011/0132683 | A1 * | 6/2011 | Miller | F41A 21/30 181/223 |
| 2012/0152649 | A1 | 6/2012 | Larue | |
| 2014/0299405 | A1 * | 10/2014 | Miller | F41A 21/30 181/223 |
| 2016/0008968 | A1 * | 1/2016 | Neubauer | B25B 15/005 7/138 |
| 2016/0018179 | A1 | 1/2016 | Morris et al. | |
| 2016/0084602 | A1 * | 3/2016 | Smith | F41A 21/30 89/14.4 |
| 2016/0161203 | A1 * | 6/2016 | Wilson | F41A 21/30 89/14.3 |
| 2016/0187093 | A1 * | 6/2016 | Barrett | F41A 21/30 89/14.4 |
| 2017/0067711 | A1 * | 3/2017 | Slack | F41A 21/30 |
| 2017/0131065 | A1 * | 5/2017 | Whitson | F41G 1/01 |
| 2017/0205175 | A1 * | 7/2017 | Garst | F41A 21/30 |
| 2017/0261281 | A1 * | 9/2017 | Salvador | F41A 21/325 |
| 2017/0299312 | A1 * | 10/2017 | Llewellyn, Jr. | F41A 21/30 |
| 2018/0172383 | A1 * | 6/2018 | James | F41A 21/30 |
| 2018/0299223 | A1 * | 10/2018 | Barrett | F41A 21/28 |
| 2018/0321008 | A1 * | 11/2018 | Barney | F41A 21/30 |
| 2018/0347931 | A1 * | 12/2018 | Schoppman | F41A 21/325 |
| 2019/0063859 | A1 * | 2/2019 | Gilpin | F41A 21/30 |
| 2019/0093973 | A1 * | 3/2019 | Hamby | F41A 21/30 |

* cited by examiner

SUPPRESSOR FOR A FIREARM

FIELD OF THE INVENTION

The present invention generally involves a suppressor for a firearm.

BACKGROUND OF THE INVENTION

A conventional firearm operates by combusting gunpowder or other accelerant to generate combustion gases that propel a projectile through a barrel and out of a muzzle of the firearm. The rapidly expanding combustion gases exit the muzzle and produce a characteristic loud bang commonly associated with gunfire.

A suppressor (also commonly referred to as a silencer) is a device that attaches to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

Some suppressor designs include additional components upstream and/or downstream of the baffles to enhance the performance of the suppressor. For example, some suppressor designs include a baffle stack support assembly upstream of the baffles to facilitate connecting the suppressor to the muzzle of the firearm and/or to pre-condition the combustion gases upstream of the baffles. Other suppressor designs may alternately or additionally include an extension interface, an extension module, and/or a front cap assembly downstream of the baffles. The extension interface provides axial support to upstream baffles and the capability to add additional baffles in the extension module, if so desired. The front cap assembly provides additional axial support to the upstream baffles and further conditions the combustion gases before exiting the suppressor to enhance the expansion, cooling, and/or energy dissipation of the combustion gases passing through the suppressor.

The various optional components typically releasably attach to the casing to facilitate rapid installation, removal, and servicing of the optional components when necessary to optimize the configuration and performance for the suppressor. A separate tool is often needed to securely install or rapidly remove the components from the suppressor. While the use of a separate tool may provide for more secure installation or facilitate faster removal of the components, the need for a separate tool may impact continued operation, modification, or maintenance of the suppressor in the field where the tool may be lost or otherwise not available. Therefore, the need exists for an improved suppressor that does not require a separate tool to securely install or rapidly remove components from the suppressor.

BRIEF DESCRIPTION OF THE INVENTION

Aspects and advantages of the invention are set forth below in the following description, or may be obvious from the description, or may be learned through practice of the invention.

One embodiment of the present invention is a suppressor for a firearm. The suppressor includes a casing that defines a rear end opposed to a front end. A plurality of baffles are inside the casing. A rear cap is upstream from the plurality of baffles and releasably coupled to the rear end of the casing, and the rear cap includes an upstream surface. A rear cap surface feature is defined by the upstream surface of the rear cap. A front cap is downstream from the plurality of baffles and releasably coupled to the front end of the casing, and the front cap includes an upstream surface. A front cap surface feature is defined by the front cap, and the front cap surface feature has a complementary shape to the rear cap surface feature so the front cap surface feature can engage with the rear cap surface feature to remove the rear cap from the casing.

An alternate embodiment of the present invention is a suppressor for a firearm that includes a casing and a plurality of baffles inside the casing. A rear cap is in threaded engagement with the casing upstream from the plurality of baffles. A front cap is in threaded engagement with the casing downstream from the plurality of baffles, and the front cap includes an upstream surface. A tool is defined by the front cap, and the tool is configured to engage with the rear cap to remove the rear cap from the casing.

In yet another embodiment of the present invention, a suppressor for a firearm includes a casing that defines a rear end opposed to a front end. A plurality of baffles are inside the casing. A rear cap is upstream from the plurality of baffles and releasably coupled to the rear end of the casing, and the rear cap includes an upstream surface. A front cap is downstream from the plurality of baffles and releasably coupled to the front end of the casing. A front cap surface feature is defined by the front cap, and the front cap surface feature is configured to engage with the upstream surface of the rear cap to remove the rear cap from the casing.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
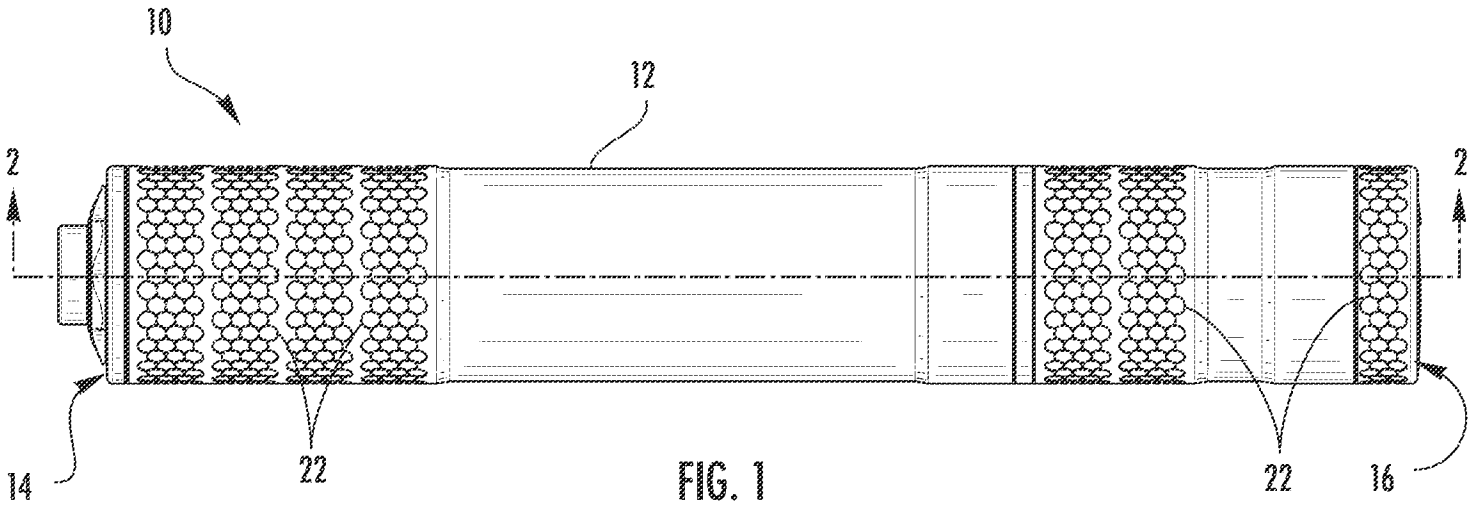
FIG. 1 is a side plan view of a suppressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. As used herein, the term "axial" refers to a direction of flow through an object; the term "radial" refers to a direction extending away from the center of an object or normal to the "axial" direction, and the term "circumferential" refers to a direction extending around the circumference or perimeter of an object.

Figure 2:
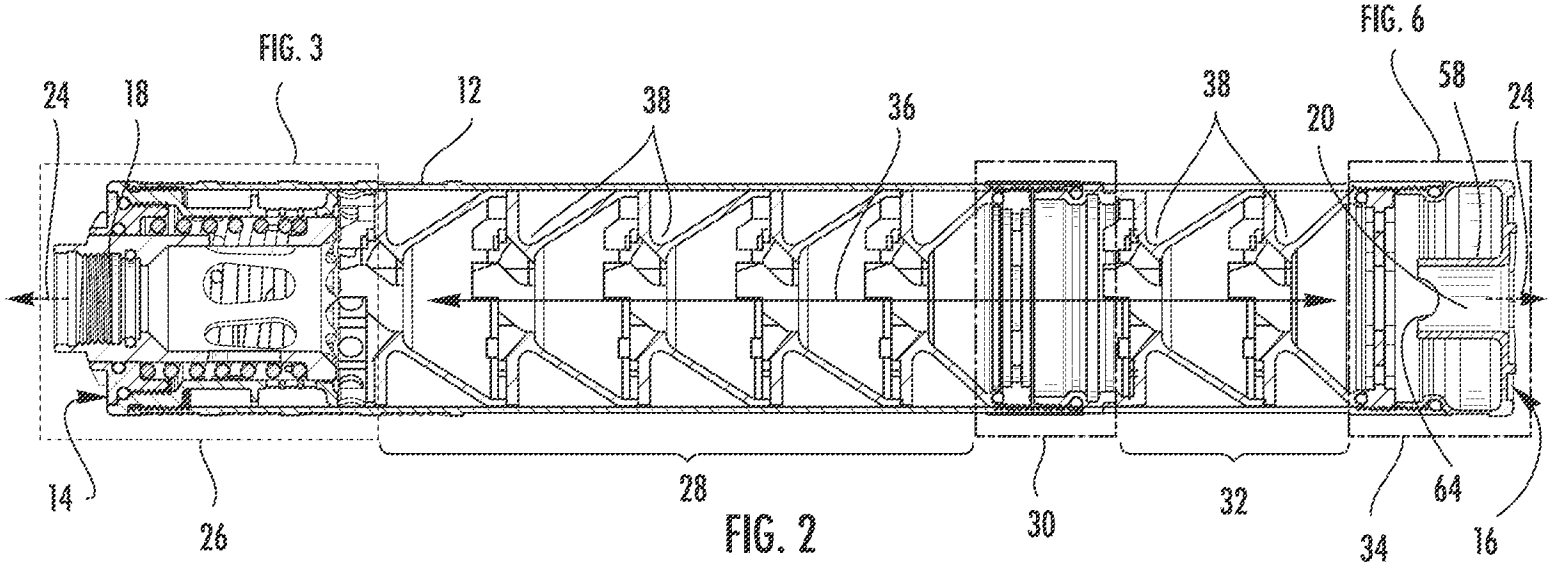
FIG. 2 is a side cross-section view of the suppressor shown in FIG. 1 taken along line 2-2.

Embodiments of the present invention provide a suppressor for a firearm with improved sound damping and/or thermal performance compared to existing suppressor designs. FIG. 1 provides a side plan view of a suppressor 10 according to one embodiment of the present invention, and FIG. 2 provides a side cross-section view of the suppressor 10 shown in FIG. 1 taken along line 2-2. As shown in FIGS. 1 and 2, the suppressor 10 generally includes a casing 12 that contains the internal components of the suppressor 10 and provides the structure for connecting the suppressor 10 to the firearm. For convention, a rear end 14 of the casing 12 refers to the end of the casing 12 that connects to the firearm, and a front end 16 of the casing 12 refers to the opposite end of the casing 12 from which a bullet or other projectile exits.

The rear end 14 of the casing 12 generally includes means 18 for releasably attaching the suppressor 10 to the firearm. The function of the means 18 is to connect or disconnect the suppressor 10 to the firearm. The structure for performing this function may include any combination of compression fittings, threaded fittings, quick release connectors, clamps, latches, hasps, or other well-known mechanical devices suitable for releasably coupling one component to another. The front end 16 of the casing 12 generally terminates in an opening 20 through which the bullet or other projectile from the firearm passes. The casing 12 may further include various textured surfaces 22 between the rear and front ends 14, 16 to facilitate handling and gripping the suppressor 10.

As shown in FIG. 2, the casing 12 generally defines a longitudinal axis 24 for the suppressor 10 and contains the internal components of the suppressor 10. The casing 12 and internal components of the suppressor 10 may be constructed from any material suitable for exposure to the pressures and temperatures normally associated with the discharge of a firearm. For example, in particular embodiments, the casing 12 and internal components of the suppressor 10 may be constructed from metal, fiberglass, carbon, polymers, or other composite materials known in the art. The casing 12 is typically cylindrical, although the particular geometry of the casing 12 is not a limitation of the present invention unless specifically recited in the claims.

In the particular embodiment shown in FIG. 2, the suppressor 10 includes a rear baffle stack support assembly 26, a baffle stack assembly 28, an extension interface 30, an extension module 32, and a front cap assembly 34 that define a fluid pathway 36 along the longitudinal axis 24 through the suppressor 10. The rear baffle stack support assembly 26 generally includes structure for connecting the suppressor 10 to the firearm, as well as structure for pre-conditioning the combustion gases upstream of the baffle stack assembly 28. The baffle stack assembly 28 generally includes a series of baffles 38 in a stacked relationship to further cool and reduce the energy of the combustion gases. For example, as shown in FIG. 2, the baffle stack assembly 28 may include five baffles 38 sequentially stacked together. The extension interface 30 provides axial support to upstream baffles 38 and expansion capability to add additional baffles 38 in the extension module 32, if so desired. The front cap assembly 34 provides additional axial support to the upstream baffles 38 and further conditions the combustion gases before exiting the suppressor 10 to enhance the expansion, cooling, and/or energy dissipation of the combustion gases passing through the suppressor 10.

Figure 3:
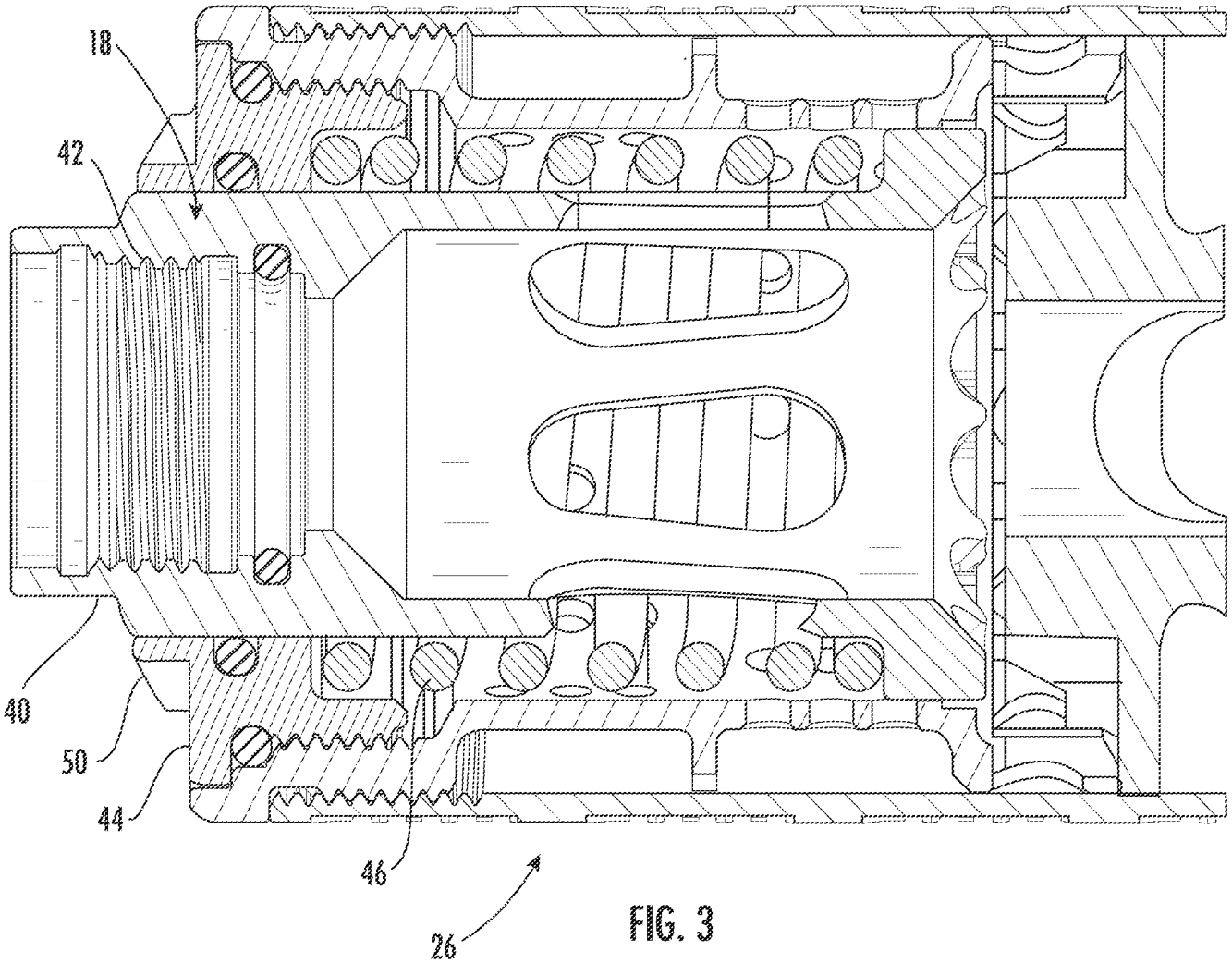
FIG. 3 is an enlarged view of the rear baffle stack support assembly shown in FIG. 2.

FIG. 3 provides an enlarged view of the rear baffle stack support assembly 26 shown in FIG. 2. In this particular embodiment, the means 18 for releasably attaching the suppressor 10 to the firearm includes an adaptor 40 with female threads 42 located at the rear end 14 of the casing 12. As shown in FIG. 3, a rear cap 44 is releasably coupled in threaded engagement to the rear end 14 of the casing 12, and a spring 46 is operably engaged between the adaptor 40 and the rear cap 44. The spring 46 biases the adaptor 40 away from the rear cap 44 and into the casing 12 while allowing the adaptor 40 to slide axially with respect to the rear cap 44 to facilitate threading the adaptor 40 onto complementary male threads on the firearm. In addition, the releasable coupling between the rear cap 44 and the casing 12 allows the rear cap 44 to be removed from the casing 12 to facilitate maintenance, repairs, or replacement of components inside the casing 12.

Figure 4:
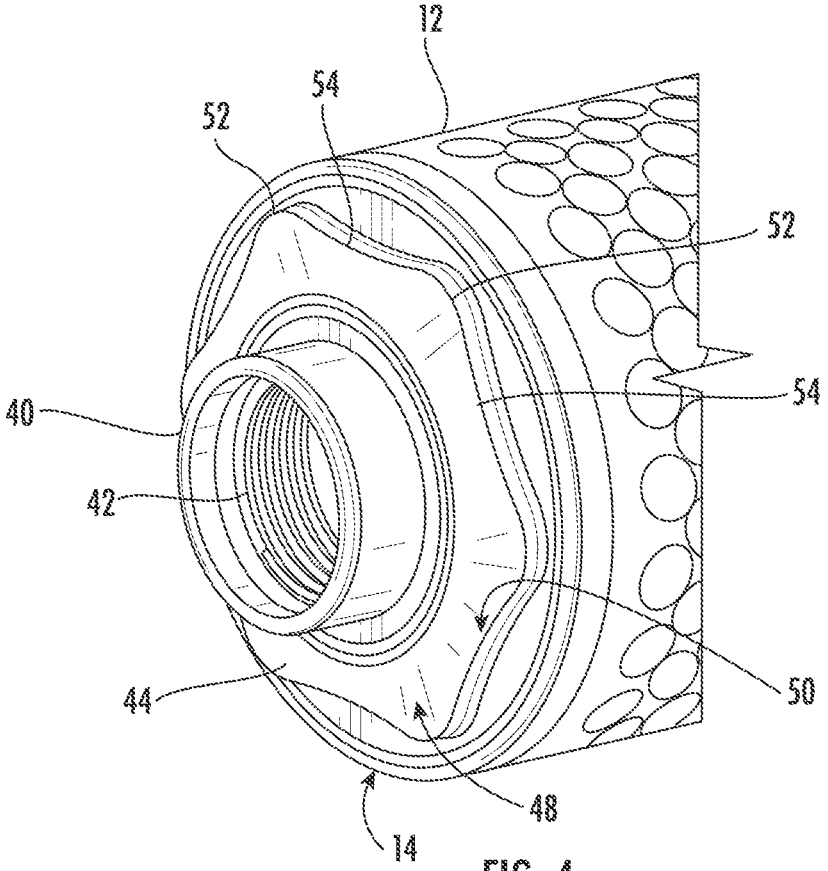
FIG. 4 is a rear perspective view of the suppressor shown in FIGS. 1 and 2.
Figure 5:
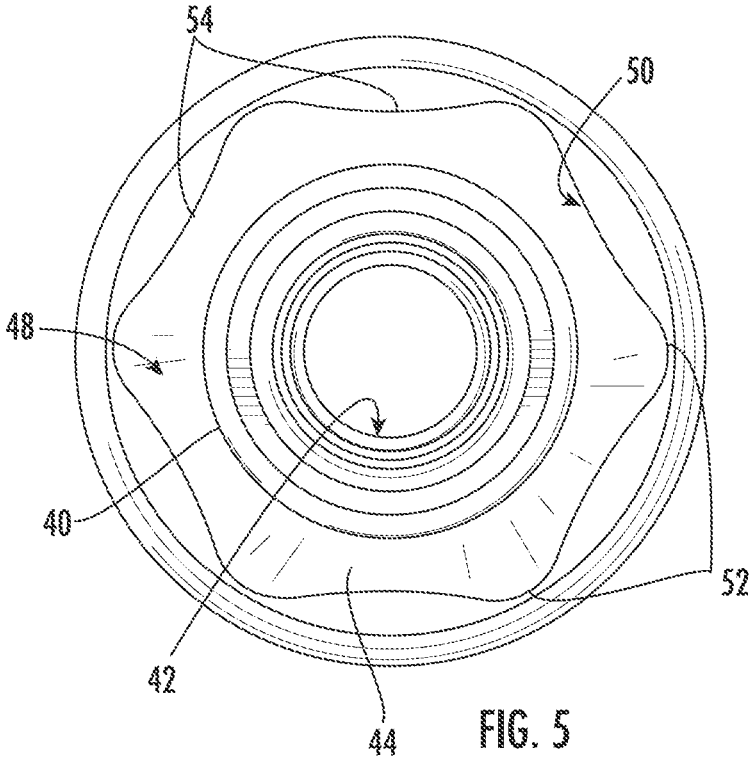
FIG. 5 is rear plan view of the suppressor shown in FIGS. 1 and 2.

FIG. 4 provides a rear perspective view and FIG. 5 provides rear plan view of the suppressor 10 shown in FIGS.

1 and 2. As shown in FIGS. 4 and 5, the rear cap 44 includes an upstream surface 48 that defines a rear cap surface feature 50. The rear cap surface feature 50 may be any geometric shape, combination of geometric shapes, projection, indention, or combination of projections and/or indentions that allow the rear cap 44 to be gripped or grasped so it may be rotated with respect to the casing 12 to install or remove the rear cap 44 from the casing 12. In the particular embodiment shown in FIGS. 4 and 5, the rear cap surface feature 50 is a hexagonal projection in the upstream surface 48 of the rear cap 44, with six vertices 52 separated by six sides 54. Although the vertices 52 are rounded and the sides 54 are curved, embodiments of the present invention are not limited to any particular geometry unless specifically recited in the claims.

Figure 6:
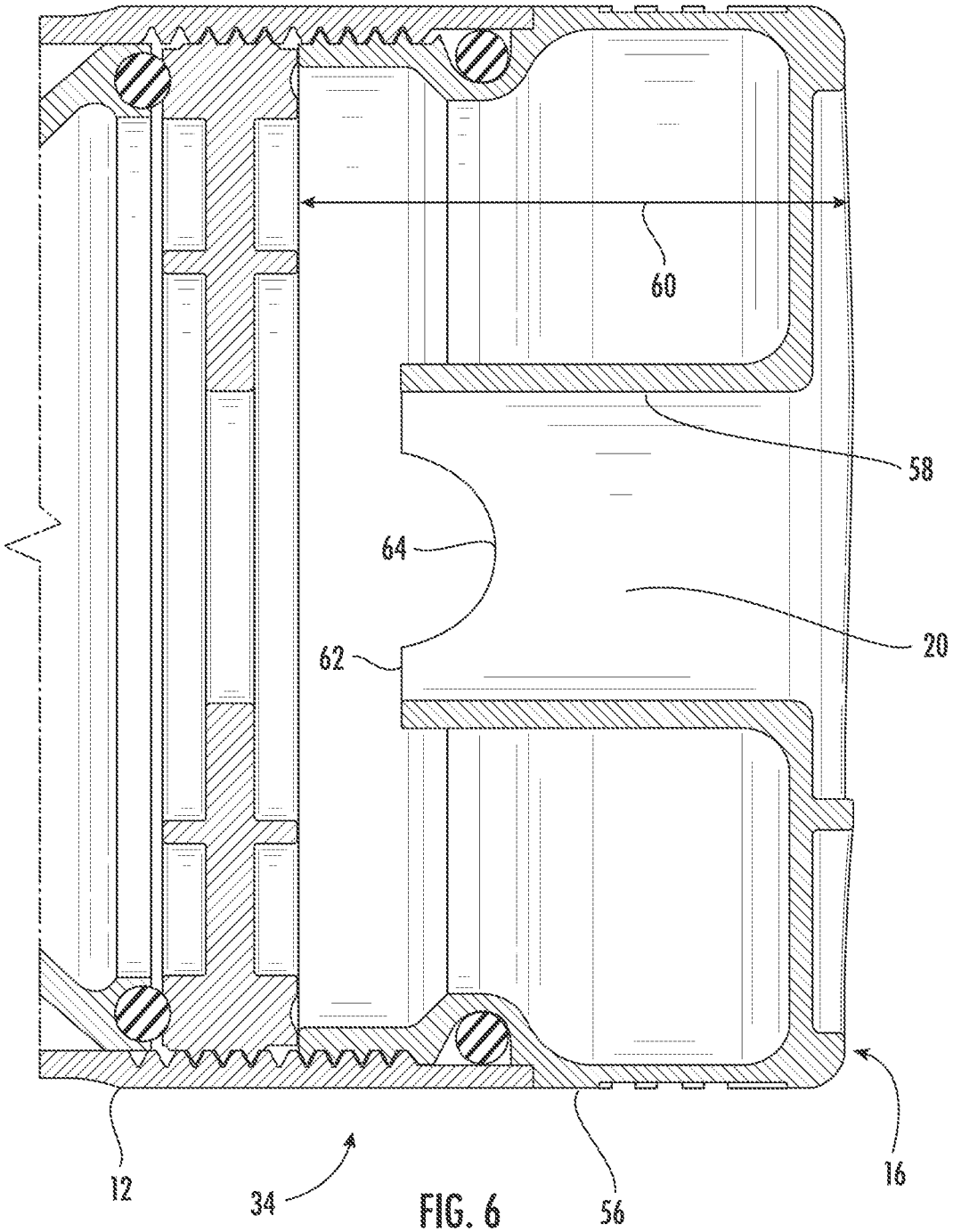
FIG. 6 is an enlarged view of the front cap assembly shown in FIG. 2.

FIG. 6 provides an enlarged view of the front cap assembly 34 shown in FIG. 2. As shown in FIG. 6, the front cap assembly 34 includes a front cap 56 releasably coupled in threaded engagement with the casing 12 at the front end 16 of the suppressor 10. The opening 20 in the front cap 56 defines the fluid pathway 36 along the longitudinal axis 24 to allow the projectile and combustion gases to exit the suppressor 10. As shown in FIGS. 2 and 6, the opening 20 may be defined by a cylindrical tube 58 that extends upstream from the front end 16 of the suppressor 10. In particular embodiments, the cylindrical tube 58 may extend upstream from the front end 16 of the suppressor 10 more than 25% or 50% of an axial length 60 of the front cap 56. In addition, as shown most clearly in FIG. 6, the cylindrical tube 58 may include an upstream end 62 with an arcuate relief 64 at the upstream end 62. It is believed that the cylindrical tube 58 in conjunction with the arcuate relief 64 further damps noise from the suppressor 10 by enhancing the expansion, cooling, and/or energy dissipation of the combustion gases prior to exiting the front cap 56 of the suppressor 10.

Figure 7:
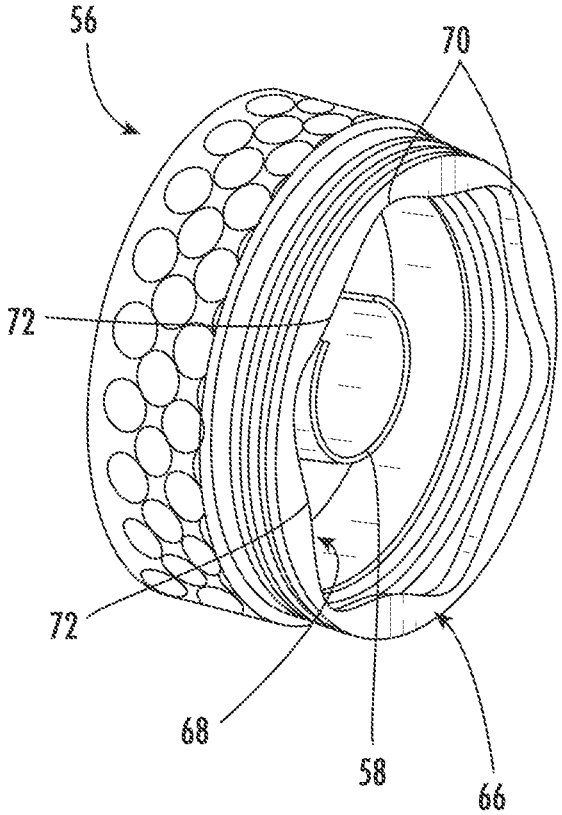
FIG. 7 is a rear perspective view of the front cap shown in FIGS. 2 and 6 removed from the suppressor.
Figure 8:
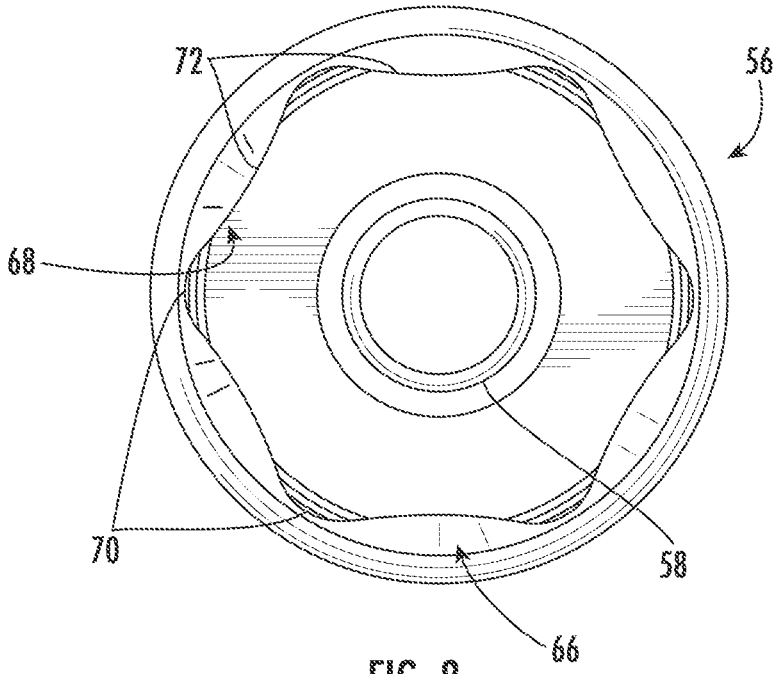
FIG. 8 is a rear plan view of the front cap shown in FIGS. 2 and 6 removed from the suppressor.

FIG. 7 provides a rear perspective view and FIG. 8 provides a rear plan view of the front cap 56 shown in FIGS. 2 and 6 removed from the suppressor 10. As shown in FIGS. 7 and 8, the front cap 56 includes an upstream surface 66 that defines a front cap surface feature or tool 68. The front cap surface feature or tool 68 may be any geometric shape, combination of geometric shapes, projection, indention, or combination of projections and/or indentions having a complementary shape to the rear cap surface feature 50 so the front cap surface feature or tool 68 can engage with the rear cap surface feature 50 to install or remove the rear cap 44 from the casing 12. In the particular embodiment shown in FIGS. 7 and 8, the front cap surface feature or tool 68 is a hexagonal indention in the upstream surface 66 of the front cap 56, with six vertices 70 separated by six sides 72. Although the vertices 70 are rounded and the sides 72 are curved, embodiments of the present invention are not limited to any particular geometry unless specifically recited in the claims.

Figure 9:
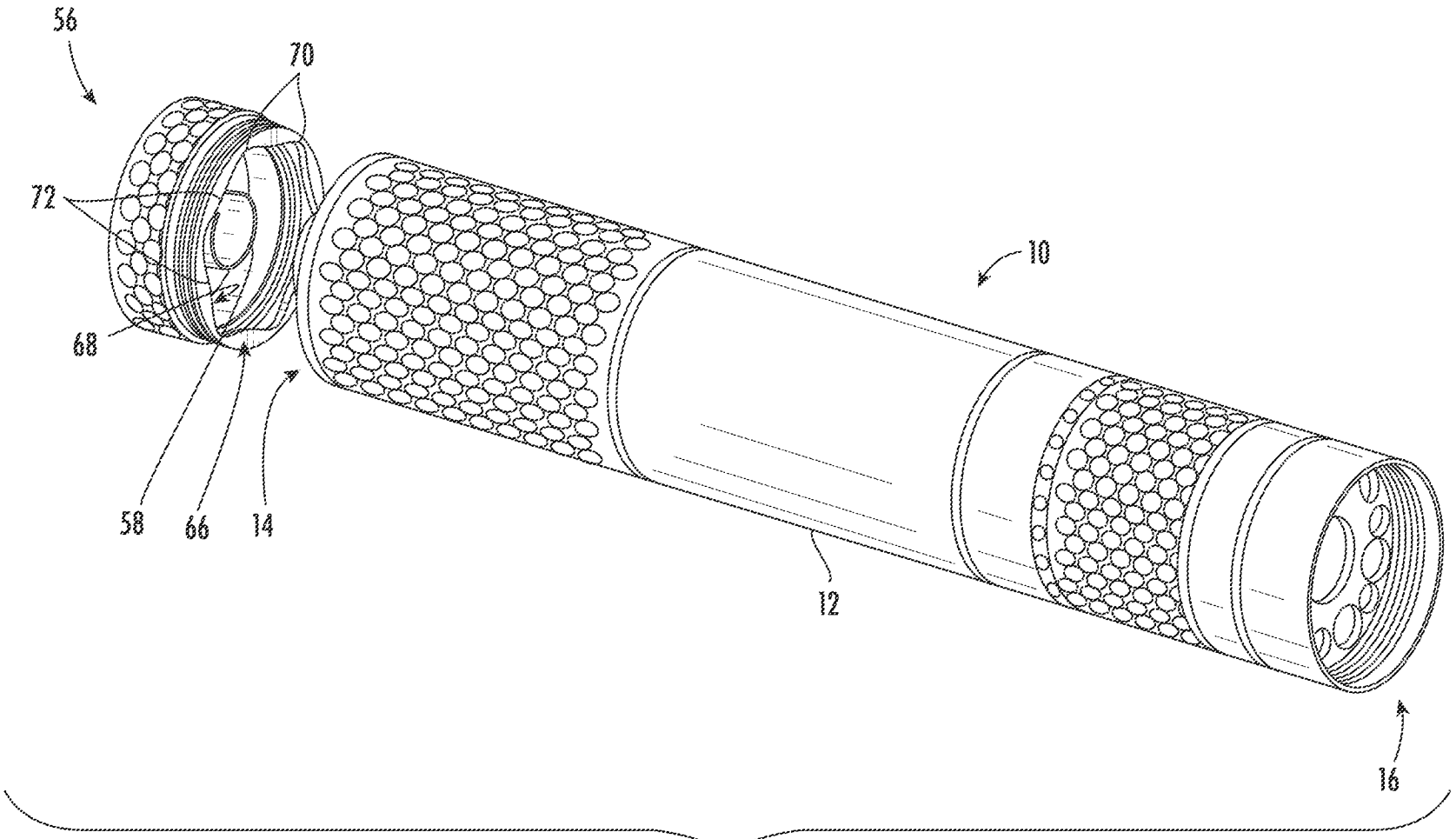
FIG. 9 is a perspective view of the suppressor shown in FIGS. 1 and 2 with the front cap removed from the front of the suppressor, reversed, and positioned near the rear of the suppressor.
Figure 10:
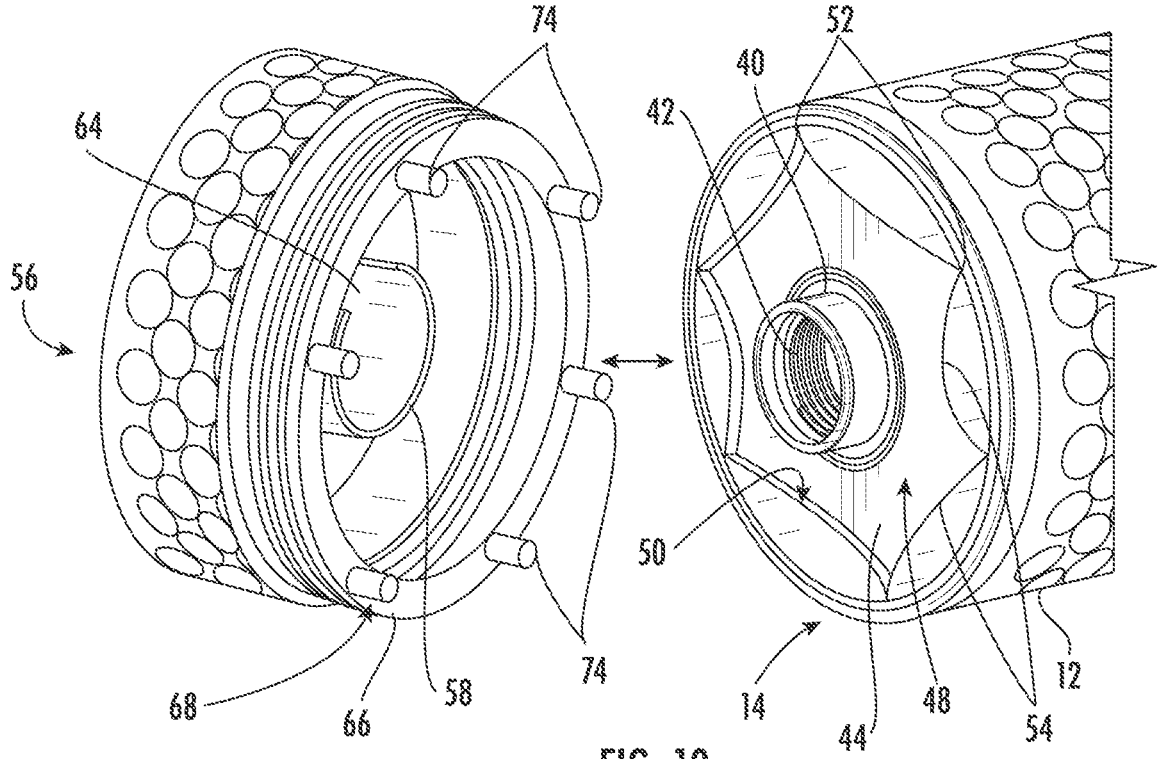
FIG. 10 is a perspective view of a second embodiment of the suppressor shown in FIGS. 1 and 2 with the front cap removed from the front of the suppressor, reversed, and positioned near the rear of the suppressor.

FIG. 9 provides a perspective view of the suppressor 10 shown in FIGS. 1 and 2 with the front cap 56 removed from the front of the suppressor 10, reversed, and positioned near the rear of the suppressor 10. As shown in FIG. 9, the front cap surface feature or tool 68 has a complementary shape to the rear cap surface feature 50 that enables the front cap surface feature or tool 68 to engage with the rear cap surface feature 50. As a result, rotation of the front cap 56 will in turn rotate the rear cap 44, allowing the front cap 56 to securely install or rapidly remove the rear cap 44.

FIGS. 10-13 provide rear perspective views of alternate embodiments of the suppressor 10 shown in FIGS. 1 and 2 with the front cap 56 removed from the front of the suppressor 10, reversed, and positioned near the rear of the suppressor 10 to illustrate various embodiments that fall within the scope of the present invention. In the embodiment shown in FIG. 10, the rear cap surface feature 50 defined by the upstream surface 48 of the rear cap 44 is a recessed hexagonal shape formed by alternating vertices 52 and sides 54, and the front cap surface feature or tool 68 is a series of six pins 74 that project from the perimeter of the upstream surface 66 of the front cap 56. To install or remove the rear cap 44 from the suppressor 10, a user may align and engage the pins 74 of the front cap surface feature or tool 68 with the vertices 52 of the rear cap surface feature 50 and rotate the front cap 56 to in turn rotate the rear cap 44 with respect to the casing 12.

Figure 11:
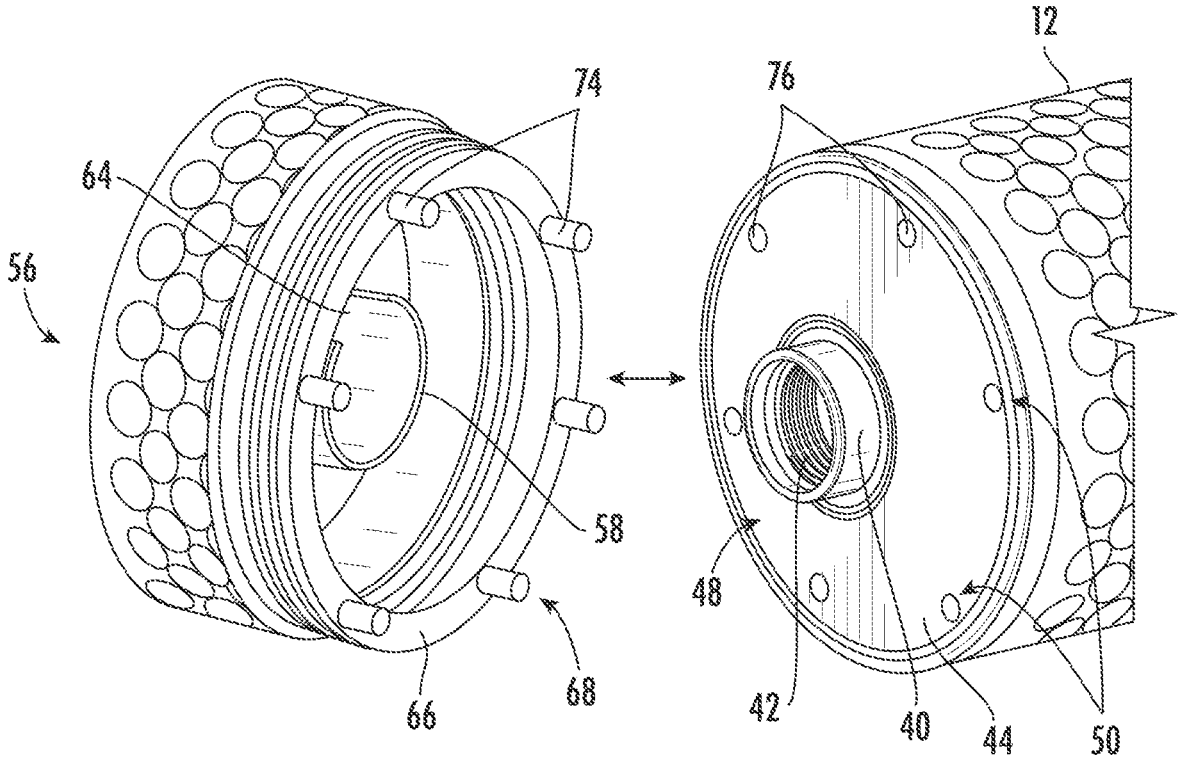
FIG. 11 is a perspective view of a third embodiment of the suppressor shown in FIGS. 1 and 2 with the front cap removed from the front of the suppressor, reversed, and positioned near the rear of the suppressor.
Figure 12:
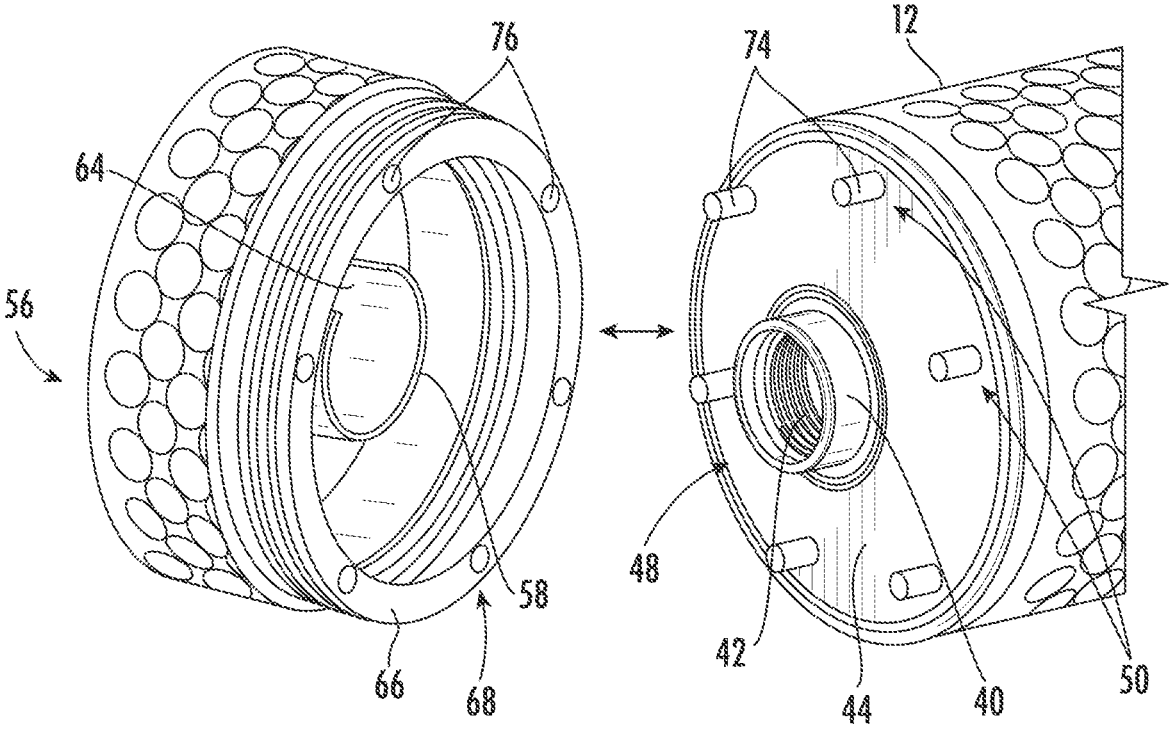
FIG. 12 is a perspective view of a fourth embodiment of the suppressor shown in FIGS. 1 and 2 with the front cap removed from the front of the suppressor, reversed, and positioned near the rear of the suppressor.

In the embodiment shown in FIG. 11, the front cap surface feature or tool 68 is again a series of six pins 74 that project from the perimeter of the upstream surface 66 of the front cap 56, and the rear cap surface feature 50 is a series of six holes 76 in the perimeter of the upstream surface 48 of the rear cap 44. The embodiment shown in FIG. 12 is reversed from the embodiment shown in FIG. 11, with the holes 76 in the front cap surface feature or tool 68 and the pins 74 projecting from the rear cap surface feature 50. To install or remove the rear cap 44 from the suppressor 10 for either embodiment, a user may align and engage the pins 74 with the holes 76 and rotate the front cap 56 to in turn rotate the rear cap 44 with respect to the casing 12.

Figure 13:
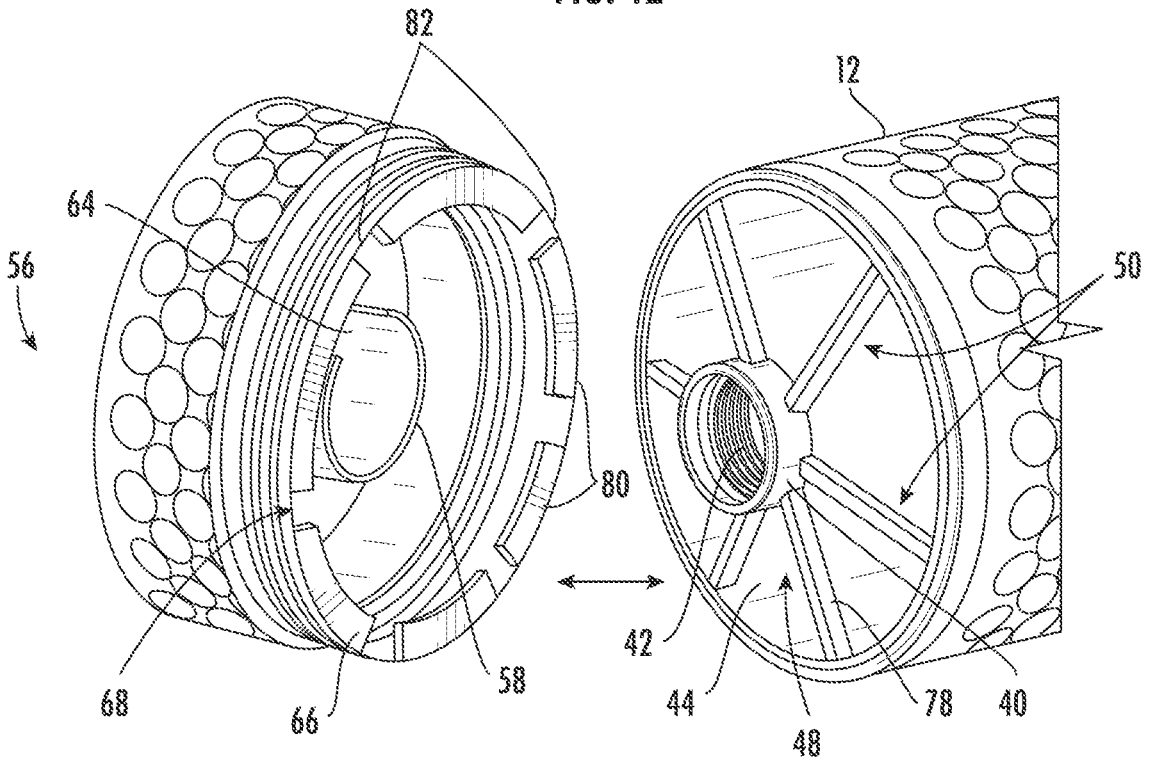
FIG. 13 is a perspective view of a fifth embodiment of the suppressor shown in FIGS. 1 and 2 with the front cap removed from the front of the suppressor, reversed, and positioned near the rear of the suppressor.

In the embodiment shown in FIG. 13, the rear cap surface feature 50 is a series of six radially extending spokes 78 that project from the upstream surface 48 of the rear cap 44, and the front cap surface feature or tool 68 is a series of segments 80 and gaps 82 in the perimeter of the upstream surface 66 of the front cap 56. To install or remove the rear cap 44 from the suppressor 10, a user may align and engage the spokes 78 with the gaps 82 and rotate the front cap 56 to in turn rotate the rear cap 44 with respect to the casing 12.

The various embodiments described and illustrated with respect to FIGS. 1-13 thus provide an improved suppressor 10 having a tool 68 incorporated into the front cap 56. In the event it is necessary to install or remove the rear cap 44 to clean, repair, or replace components inside the casing 12, a user may remove the front cap 56 from the suppressor 10 and use the front cap surface feature or tool 68 to install or remove the rear cap 44.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A suppressor for a firearm, comprising:

a casing defining a rear end opposed to a front end;

a plurality of baffles inside said casing; a rear cap upstream from said plurality of baffles and releasably coupled to said rear end of said casing, wherein said rear cap includes an upstream surface;

a rear cap surface feature defined by said upstream surface of said rear cap;

a front cap downstream from said plurality of baffles and releasably coupled to said front end of said casing, wherein said front cap includes an upstream surface;

a front cap surface feature defined by said front cap, wherein said front cap surface feature has a complementary shape to said rear cap surface feature so said front cap surface feature can engage with said rear cap surface feature to remove said rear cap from said casing; and wherein said front cap surface feature is defined by said upstream surface of said front cap.

2. The suppressor as in claim 1, wherein one of said rear cap surface feature or said front cap surface feature comprises a male fitting and the other of said rear cap surface feature or said front cap surface feature comprises a female fitting.

3. The suppressor as in claim 1, wherein one of said rear cap surface feature or said front cap surface feature comprises a plurality of holes and the other of said rear cap surface feature or said front cap surface feature comprises a plurality of pins.

4. The suppressor as in claim 1, wherein said rear cap surface feature comprises at least one vertex between a plurality of sides.

5. The suppressor as in claim 1, wherein said front cap surface feature comprises at least one vertex between a plurality of sides.

6. A suppressor for a firearm, comprising:

a casing;

a plurality of baffles inside said casing;

a rear cap in threaded engagement with said casing upstream from said plurality of baffles;

a front cap in threaded engagement with said casing downstream from said plurality of baffles, wherein said front cap includes an upstream surface;

a tool defined by said front cap, wherein said tool is configured to engage with said rear cap to remove said rear cap from said casing; and wherein said tool is defined by said upstream surface of said front cap.

7. The suppressor as in claim 6, wherein said tool comprises a male fitting.

8. The suppressor as in claim 6, wherein said tool comprises a female fitting.

9. The suppressor as in claim 6, wherein said tool comprises a plurality of holes.

10. The suppressor as in claim 6, wherein said tool comprises a plurality of pins.

11. The suppressor as in claim 6, wherein said tool comprises at least one vertex between a plurality of sides.

12. A suppressor for a firearm, comprising:

a casing defining a rear end opposed to a front end;

a plurality of baffles inside said casing;

a rear cap upstream from said plurality of baffles and releasably coupled to said rear end of said casing, wherein said rear cap includes an upstream surface;

a front cap downstream from said plurality of baffles and releasably coupled to said front end of said casing;

a front cap surface feature defined by said front cap, wherein said front cap surface feature is configured to engage with said upstream surface of said rear cap to remove said rear cap from said casing; and wherein said front cap surface feature is defined by said an upstream surface of said front cap.

13. The suppressor as in claim 12, wherein said front cap surface feature comprises a male fitting.

14. The suppressor as in claim 12, wherein said front cap surface feature comprises a female fitting.

15. The suppressor as in claim 12, wherein said front cap surface feature comprises a plurality of holes.

16. The suppressor as in claim 12, wherein said front cap surface feature comprises a plurality of pins.

17. The suppressor as in claim 12, wherein said front cap surface feature comprises at least one vertex between a plurality sides.

* * * * *